US011339608B2

(12) United States Patent
Norton

(10) Patent No.: US 11,339,608 B2
(45) Date of Patent: May 24, 2022

(54) ADJUSTABLE SPRING SYSTEM AND METHOD FOR ROLLER BLINDS

(71) Applicant: BLINDWARE PTY LTD, Bayswater (AU)

(72) Inventor: Grant Raymond Norton, Bayswater (AU)

(73) Assignee: BLINDWARE PTY LTD, Bayswater (AU)

( * ) Notice: Subject to any disclaimer, the term of this patent is extended or adjusted under 35 U.S.C. 154(b) by 410 days.

(21) Appl. No.: 16/332,966

(22) PCT Filed: Sep. 11, 2017

(86) PCT No.: PCT/AU2017/000191
§ 371 (c)(1),
(2) Date: Mar. 13, 2019

(87) PCT Pub. No.: WO2018/049462
PCT Pub. Date: Mar. 22, 2018

(65) Prior Publication Data

US 2019/0257146 A1 Aug. 22, 2019

(30) Foreign Application Priority Data

Sep. 13, 2016 (AU) ..... 2016903675

(51) Int. Cl.
*E06B 9/90* (2006.01)
*E06B 9/42* (2006.01)
*E06B 9/60* (2006.01)

(52) U.S. Cl.
CPC ..... *E06B 9/42* (2013.01); *E06B 9/60* (2013.01); *E06B 9/90* (2013.01); *E06B 2009/905* (2013.01)

(58) Field of Classification Search
CPC ..... E06B 9/90; E06B 2009/905; E06B 9/60; E06B 9/62
See application file for complete search history.

(56) References Cited

U.S. PATENT DOCUMENTS 208,417 A * 9/1878 Noyes ..... E06B 9/60 160/306
260,045 A 6/1882 Osgood
(Continued)

FOREIGN PATENT DOCUMENTS

CL 201402279 11/2014
CN 1720384 A 1/2006
(Continued)

OTHER PUBLICATIONS

First Office Action issued in Chinese Patent Application No. 201780067663.7, dated Mar. 18, 2020.
(Continued)

*Primary Examiner* — Johnnie A. Shablack
*Assistant Examiner* — Jeremy C Ramsey
(74) *Attorney, Agent, or Firm* — Brooks Kushman P.C.

(57) ABSTRACT

A method for altering the spring constant (k) of a torsion spring for a roller blind, the method including (i) locating a dampener at a predetermined length along a longitudinal axis of the torsion spring, and (ii) tightening an end of the torsion spring against the dampener to increase the spring constant. Further disclosed is a roller blind system having a cylinder, a fabric attached to the cylinder for winding and unwinding from said cylinder, a torsion spring and a damper moveable along the longitudinal axis of the spring.

10 Claims, 6 Drawing Sheets

(56) References Cited

U.S. PATENT DOCUMENTS

| | | | | |
|---|---|---|---|---|
| 2,924,411 | A | 2/1960 | Rouverol | |
| 4,535,829 | A * | 8/1985 | Fukuchi | E06B 9/60 160/291 |
| 5,275,223 | A | 1/1994 | Magro | |
| 6,467,714 | B1 | 10/2002 | Rasmussen | |
| 7,967,051 | B2 * | 6/2011 | Diaz | E05D 13/1261 160/188 |
| 8,528,623 | B2 | 9/2013 | Roberts | |
| 2011/0005694 | A1 | 1/2011 | Ng | |
| 2011/0297334 | A1 | 12/2011 | Bohlen | |
| 2013/0153161 | A1 * | 6/2013 | Haarer | E06B 9/42 160/293.1 |

FOREIGN PATENT DOCUMENTS

| | | | |
|---|---|---|---|
| CN | 205036281 | U | 2/2016 |
| DE | 202012012664 | U1 | 11/2013 |
| DE | 102012011796 | A1 | 12/2013 |
| EP | 1746245 | A2 | 1/2007 |
| GB | 222936 | A | 10/1924 |
| WO | 2013129915 | A1 | 9/2013 |

OTHER PUBLICATIONS

First Examination Report issued in Chilean Patent Application No. 00599-2019, dated Mar. 13, 2020.
Supplementary Search Report issued in European Patent Application No. 17849910.9, dated Jan. 4, 2020.

* cited by examiner

ADJUSTABLE SPRING SYSTEM AND METHOD FOR ROLLER BLINDS

CROSS-REFERENCE TO RELATED APPLICATION

This application is the U.S. national phase of PCT Application No. PCT/AU2017/000191 filed on Sep. 11, 2017, which claims priority to AU Patent Application No. 2016903675 filed on Sep. 13, 2016, the disclosures of which are incorporated in their entirety by reference herein.

FIELD OF INVENTION

The present invention relates to the field of spring assisted roller blinds and a spring adjustment mechanism for such roller blinds

BACKGROUND ART

It is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

A standard clutch operated roller blind system typically includes a rectangular sheet of flexible fabric having one end secured to a rotatable cylinder, and the opposite, free end secured to a weight bar. The fabric is typically referred to as a blind, awning or shade. The ends of the cylinder are supported by brackets mounted on a structure such as a wall or window frame.

A winder comprising a clutch or other manual or automatic winding mechanism is located at a first end of the cylinder and can be used to extend or retract the fabric over an area or opening to be covered (e.g. a wall or window). Typically, a user controls the rotation of the winder and cylinder by a cord or chain, or alternatively the user controls a small motor that rotates the cylinder. An idler at the other one end of the cylinder rotates relative to the supporting bracket. The clutch prevents the fabric from unrolling from the cylinder under the fabric's own weight.

If the fabric is particularly heavy, such as when the area to be covered by the blind is very large, the roller blind may also be spring assisted. The spring winds and tightens when the blind is lowered by an operator so that upon lifting the blind, the spring can release the stored energy and assist the operator to roll the fabric back onto the cylinder and lift the blind.

For perfectly balanced operation of the roller blind, the spring characteristics (such as wire diameter, spring diameter and length) are chosen to match the characteristics of the blind. In reality, blind springs are not custom made for every blind, but are manufactured in incremental sizes.

The length of the spring and corresponding number of turns of the spring wire determines the maximum number of rotations it will be able to make, which in turn dictates the maximum height of the blind for a given cylinder diameter.

If the spring is oversized or undersized, the operating force will change during operation as the torque exerted on the cylinder by the fabric and weight bar changes as the fabric is wound and unwound. This causes the user to notice an unevenness in the operating force and the cylinder will accelerate or resist travel as the blind is raised. The result is that the force required to pull the lift cord or chain to lift and lower the roller blind is uneven and the force required to be exerted becomes more or less as the blind travels between the fully retracted and fully extended fabric positions and vice versa.

In order to obtain optimal balance in a roller blind, manufactures have to choose a different spring for each blind depending on fabric and weight bar weight. The spring is designed for a 'sweet spot' or optimal torque during operation and likely does not create perfectly balanced operation for most blinds.

In the past, attempts have been made to overcome the problem of uneven operating force. For example, US patent application 2011/0297334 (Hunter Douglas Industries BV) teaches the use of a mathematical protocol for selection of springs, preferably with at least two springs chosen in accordance with the protocol to achieve constant operating force. This is onerous for manufacturers offering a range of blinds of different sizes and different fabric weights. It is particularly onerous for manufacturers offering bespoke blind manufacture because it ads to design complexity and manufacturing stock inventory.

In another attempt at overcoming uneven operating force U.S. Pat. No. 6,467,714 teaches the use of braking device comprising a second spring or a piston that provides axial force against a spring of a blind system to obtain any desired compression spring characteristic.

US patent application 2011/0005694 discloses a spring assisted electric motor driven lifting mechanism for lifting and lowering a blind which includes a spring preload adjuster to adjust tension on the torsion spring to match the torque output of the electric motor, the adjuster extending perpendicularly away from the axis of the spring.

Accordingly, there is a need for improvement in obtaining or optimising balance in spring assisted roller blinds.

SUMMARY OF INVENTION

An object of the present invention is to provide a method for adjusting spring assisted roller blinds.

Another object of the present invention is to provide a system for adjusting assisted roller blinds that provides improved balance of the forces required to operate a lift cord or chain through the entire extending and retracting of blind fabric.

Another object of the present invention is to provide an improved method for optimising spring torque for spring assisted roller blinds.

Another object of the present invention is to provide an improved method for adjusting the characteristics of springs used in spring assisted roller blinds.

A further object of the present invention is to alleviate at least one disadvantage associated with the related art.

It is an object of the embodiments described herein to overcome or alleviate at least one of the above noted drawbacks of related art systems or to at least provide a useful alternative to related art systems.

In a first aspect of embodiments described herein there is provided a method for altering the spring constant (k) of a torsion spring for a roller blind, the method including:

locating a dampener at a predetermined length along a longitudinal axis of the torsion spring, and tightening an end of the torsion spring against the dampener to increase the spring constant.

Typically, the spring is a helical spring comprising coils of constant or variable diameter, having a longitudinal axis, a first spring end and a second spring end.

Tightening a first spring end of the torsion spring against the dampener as the dampener is moved closer to that first spring end increases the spring constant or spring torque strength by reducing the number of active coils, effectively reducing the operating length of the torsion spring. This effectively provides a pre-tension effect that offsets the fixed weight of the blind fabric and any weight bar attached to said fabric.

In a second aspect of embodiments described herein there is provided a roller blind system including:

a cylinder having a cylinder length and a cylinder diameter, a fabric attached to said cylinder for winding and unwinding from said cylinder, the fabric having a fabric length, a fabric weight, a fabric width, a thickness and a fabric height, a torsion spring having a first spring length, a longitudinal axis and operative to assist the cylinder to drivingly rotate in at least one direction of rotation, a damper moveable along the longitudinal axis of the spring, and optionally, an idler adjacent a first end of the torsion spring, and wherein the damper can be reversibly brought into contact with the spring at a predetermined position so that the change in torque produced by the spring upon rotation of the cylinder in a first direction balances the change in torque in a second, opposite direction which is produced by the weight of fabric as the cylinder rotates.

Typically, the roller blind system additionally includes a weight bar extending along the width of the fabric and supported by the free hanging fabric. Incremental rotation of the cylinder in a first direction balances the change in torque in a second, opposite direction which is produced by the incremental increase in weight of fabric as the cylinder rotates.

Typically, if balanced, torque increase or decrease produced by the spring with rotation of the cylinder matches the increase or decrease in torque in the opposite direction that is produced by the weight of fabric as it is released from the cylinder during rotation.

Similarly, torque increase or decrease produced by the spring with rotation of the cylinder matches the increase or decrease in torque in the opposite direction that is produced by the weight of fabric as it is rolled onto the cylinder.

The damper is preferably coaxial with the helical spring (that is, enclosed within the windings of the spring) and moveable between the first spring end and the second spring end.

When the damper is brought into contact with the coils of a spring having a first spring length, the spring operates as normal between the first spring end and the damper, but the coils are inactive between the damper and the second spring end. That is to say, the damper interferes with the rotation of the spring between the damper and the second end. Thus, the spring is changed from a first k value to a second k value that is better suited to drive a cylinder with constant operating force applied to the lift cord or chain.

Typically, the damper is brought into contact with the interior surfaces of the coils of the spring by applying torque, such as winding torque, at the first spring end, causing the spring diameter to reduce, tightening the spring coils around the damper. Where there is contact, the damper thus applies a damping load in a radial direction to the spring.

In yet a further aspect of embodiments described herein there is provided a damper for location within the helical coils of a torsion spring, the damper comprising:

a plug of resilient material having a plug length, a plug width and defining a passage there through for receiving a rod co-axial with a longitudinal axis of the torsion spring, wherein tightening the coils of the spring against the plug changes the spring constant (k) of the torsion spring.

In essence, tightening the coils of the spring against the plug changes the number of active coils, which changes the spring constant of the torsion spring. Preferably one or both ends of the rod are in operative connection with the first end or the second end of the torsion spring, such as in a spring operated roller blind system.

Typically, the damper is of resilient material such as a polymer, metal or other suitable materials. Preferably the damper is of circular cross section, but other suitable shapes will be readily apparent to the person skilled in the art. The diameter of the damper should be only slightly less than the inner diameter of the spring coils to ensure easy insertion and location at any desired position along the longitudinal axis of the spring, while being quickly sensitive to the reduction in the diameter of the spring during rotation of the first or second end.

The spring assisted roller blind of the present invention may be operated by any convenient means. For example, the blind may have a clutch or other lifting mechanism for rotating the roller, which is manually operated by a user pulling on a ball-chain or cord wrapped around the clutch, or other operating means such as mechanical winder or crank.

An alternative embodiment has the spring fitted inside the cylinder without the need for a clutch using cords or chains and in such a way that allows the roller blind to be operated by hand by pulling down or up on the weight bar or the fabric itself to impart raising or lowering forces to operate the blind.

Alternatively, the spring assisted roller blind of the present invention may be operated by a small motor that rotates the roller. Preferably the motor runs on direct current (DC) power, but could run on alternating current (AC) power. The advantage of DC powered motors is that the motors can be fitted without engaging an electrician and they can be powered by a solar energy system, battery or off mains AC power through a transformer. When the motor is battery powered, the batteries can be located either inside the cylinder or outside the cylinder. If the batteries are located inside the cylinder, preferably the roller blind system includes a core housing at one end of the cylinder adapted to carry the batteries.

A user may command operation of the motor operated spring assisted roller blind by any convenient interface such as an electronic remote control, push buttons, touch pad, a command wand of adjustable length or other means. (These types of interfaces remove the need for a ball chain or cord, which are known to raise child safety concerns). The method of the present invention allows the balance of blinds to be optimised, minimising torque on a motor with concomitant reduction in wear and tear and providing increased lifespan of motor and components.

Optimally, the reduction in the amount of torque required during lifting or lowering of a blind (particularly at the extremes of blind travel) allows particularly small motors to be used to provide driving force.

In a preferred embodiment a spring assisted roller blind of the present invention is operated by a small DC motor at any speed, but preferably 20 to 40 rpm. Typically, the motor can impart any torque, but more preferably 0.1 to 1.2 Newton meters (Nm).

Other aspects and preferred forms are disclosed in the specification and/or defined in the appended claims, forming a part of the description of the invention.

In essence, embodiments of the present invention stem from the realization that the spring constant (k) of torsion spring assisted roller blind can be adjusted by making part of the spring length inactive. In particular, it is possible to use a damper to inactivate some of the coils of a coil spring between the dampener and a spring end, thus altering the spring constant. It has also been realized that this can be achieved by locating the damper at a predetermined position relative to the spring so that the change in torque produced by the spring substantially matches the change in torque in a second, opposite direction which is produced by the weight of fabric as the cylinder rotates.

Advantages provided by the present invention comprise the following:

- permits adjustment of the spring constant (k) for a given spring;
- allows optimisation of spring characteristics for a given roller blind;
- allows easy pre-rotation of the spring to create a permanent torque that offsets the fixed weight of the weight bar so that the weight of the weight bar does not cause the blind to lose its complete balance during operation;
- contributes to even operating pull force on the lift cord or chain during operation of a roller blind;
- permits a single spring to be adapted for use with multiple different sized roller blinds allowing a reduction in manufacturer inventory of springs;
- reduces the amount of torque exhibited during lifting or lowering of a blind (particularly at the extremes of blind travel) enabling small motors to be used to supply rotational driving force.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

Further disclosure, objects, advantages and aspects of preferred and other embodiments of the present application may be better understood by those skilled in the relevant art by reference to the following description of embodiments taken in conjunction with the accompanying drawings, which are given by way of illustration only, and thus are not limitative of the disclosure herein, and in which.

DETAILED DESCRIPTION

| List of Parts | |
|---|---|
| 1 | cylinder tube |
| 3 | fabric |
| 5 | weight bar |
| 7 | idler |
| 9 | control device |
| 11 | cord |
| 21 | latch device |
| 22 | rod |
| 23 | helical spring |
| 24 | fixing device |
| 26 | side of fixing device |
| 27 | compression spring |
| 28 | nut |
| 30 | grooves in nut |
| 31 | idler |
| 40 | dampener |
| 41 | cover |
| 42 | U-shaped rod |
| 45 | torsion spring |
| 47 | rod shaft (square cross section) |
| 49 | bearing |
| 51 | bracket |
| 55 | lug |

Figure 1:
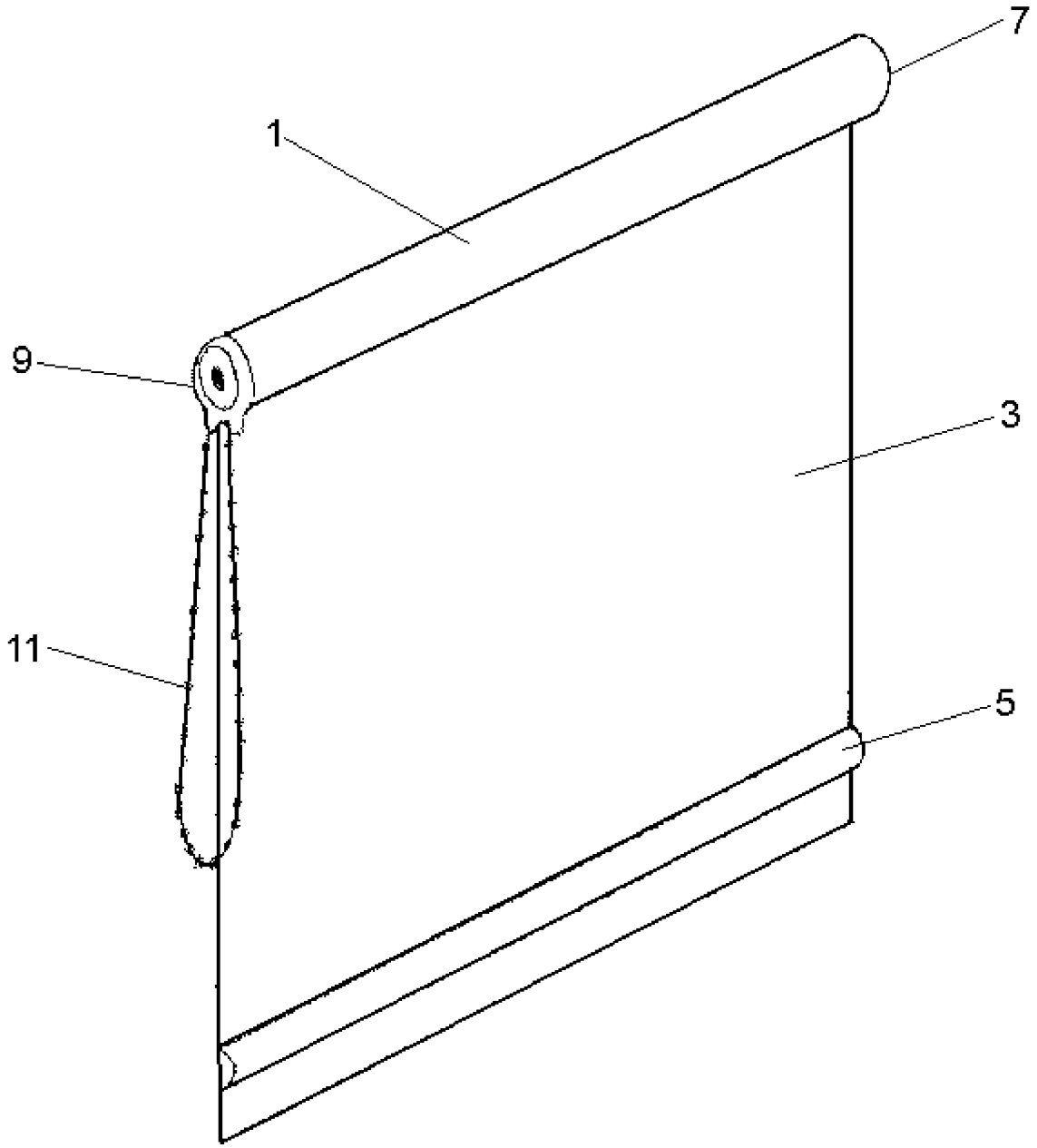
FIG. 1 (PRIOR ART)
FIG. 1 illustrates a standard clutch operated roller blind of the prior art.

FIG. 1 illustrates a standard clutch operated roller blind of the prior art comprising a cylinder tube (1), which is a metal or other material tube around which fabric (3) is wrapped. The cylinder tube (1) supports the weight of the fabric including the weight bar (5) which is heavy, and causes the fabric (3) to remain smooth and hang straight. One end of the cylinder tube (1) is supported by an idler (7) that is inserted inside and allows the tube to rotate freely even when supported by a bracket. The other end of the cylinder tube (1) is fitted with a clutch or other control device (9). The clutch allows the user to extend or retract the blind and prevents the fabric from unrolling from the cylinder under the fabric's own weight. A loop of beaded or plain cord (11) can be pulled by a user to rotate the internal components of the control device (9) and cause the rotation of the cylinder tube (1) to extend (lower) or retract (raise) the fabric (3) over an area or opening to be covered.

When the fabric (3) is fully retracted, the only torque exerted on the cylinder tube (1) is due to the weight of the weight bar (5). The torque exerted upon the cylinder increases as the fabric drops and decreases when it is raised. If the fabric (3) and base rail (5) are relatively light, then the roller blind can easily be operated manually or with minimal strain on a small motor.

However, if the fabric and base rail are particularly heavy, such as when the area to be covered by the blind is very large, the roller blind may also be spring assisted. The spring winds and tightens when the blind is lowered by an operator so that upon lifting the blind, the spring can release the stored energy to apply rotary force (torque) and assist the operator to roll the fabric back onto the cylinder and lift the blind. Typically, the spring used is a constant rotational tension spring, also called a torque spring.

Figure 2:
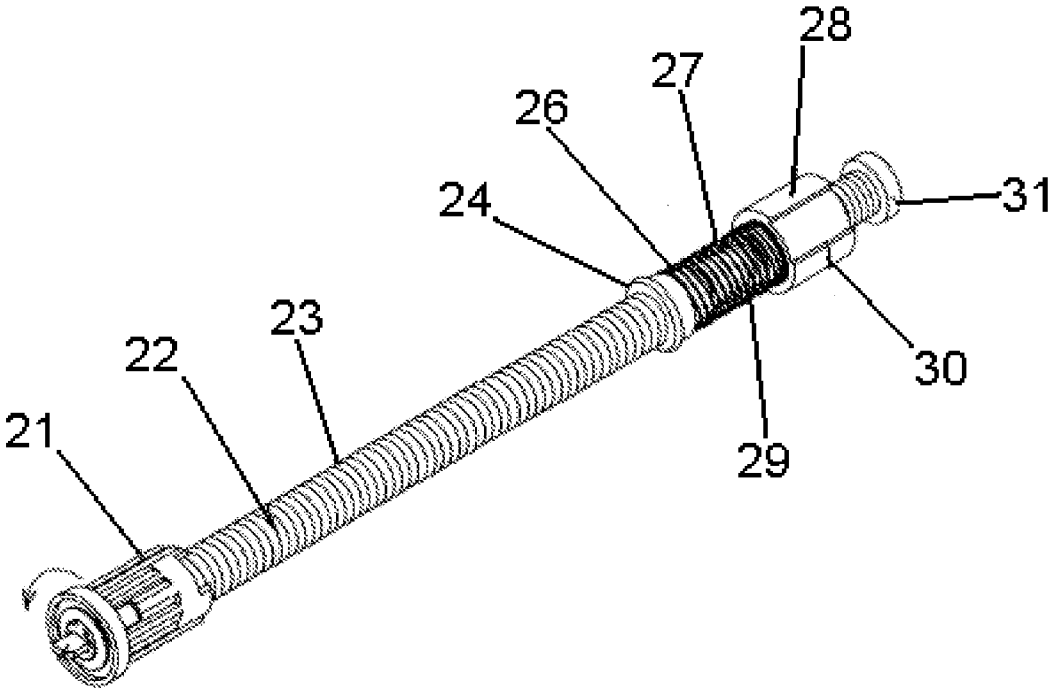
FIG. 2 (PRIOR ART)
FIG. 2 illustrates a typical mechanism for a cylinder of the prior art for a roller blind, which mechanism is normally fitted inside the cylinder tube.

FIG. 2 illustrates a typical mechanisms for a spring assisted cylinder of the prior art, which mechanism is normally fitted inside the cylinder tube which is fixed to a clutch or control unit. The mechanism consists of a rod (22) around which is fitted a helical spring (23). This is fixed between the latch device (21) and a fixing device (24) on the rod. Rotation of the cylinder tube and the latch device (21) in the direction of the arrow causes tensioning of the spring (23), that is, the fabric is pulled down. The other end of the cylinder tube (23) has an idler (31).

The side (26) of a fixing device (24) which faces away from the clutch (21) supports one end of a compression spring (27), the other end of which is supported against a nut (28). This can turn around a thread (29) on the extension of the rod (22). The nut (28) is provided with one or more groves (30) which cooperate with a longitudinal tongue in the cylinder tube (not shown in this view).

It is important for balanced operation of the roller blind that the spring dimensions (such as wire diameter, coil diameter, coil length and material of construction) represented by its spring constant (k) are chosen to match the characteristics of the blind. The length of the spring determines the maximum number of rotations it will be able to make, which in turn dictates the height of the blind for a given cylinder. The change in torque applied by a spring with each rotation is a function of its spring constant (k).

Figure 3:
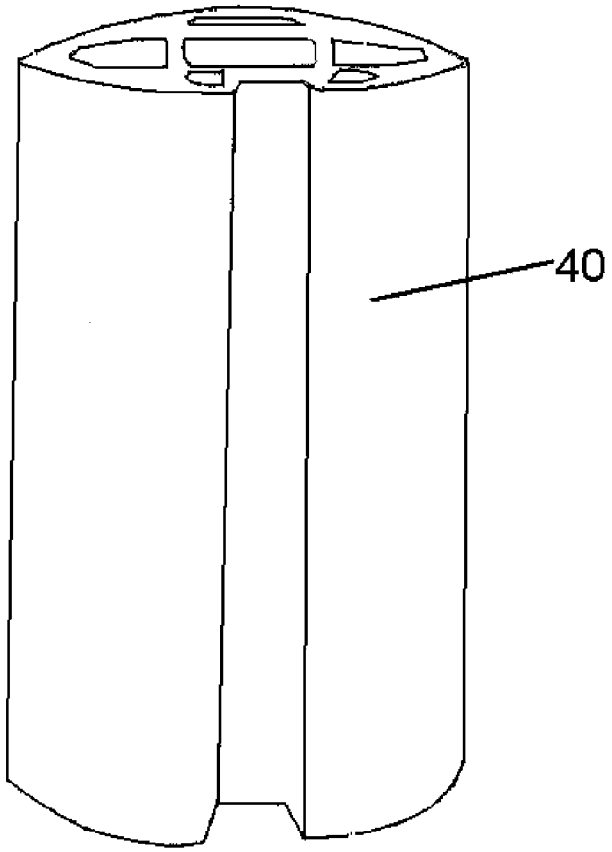
FIG. 3 illustrates a side view of a dampener according to the present invention.
Figure 4:
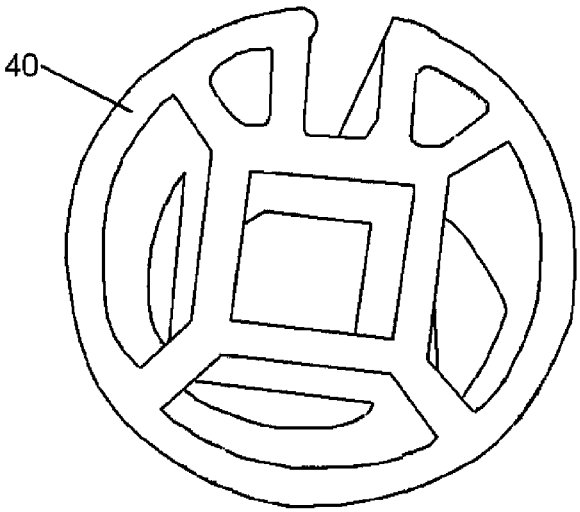
FIG. 4 is an end view of the dampener of FIG. 3.

FIG. 3 illustrates one embodiment of a dampener (40) according to the present invention in side view and FIG. 4 illustrates the same dampener in end view. Preferably the dampener is a moulded polymer, but could be made from metal or other materials.

Figure 6:
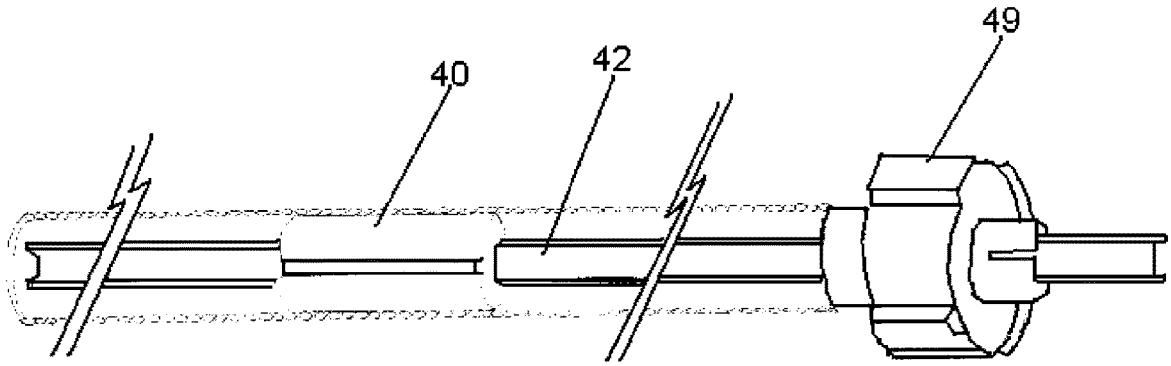
FIG. 6 illustrates the dampener of FIG. 3 relative to other elements at the other end of the spring roller blind system.
Figure 7:
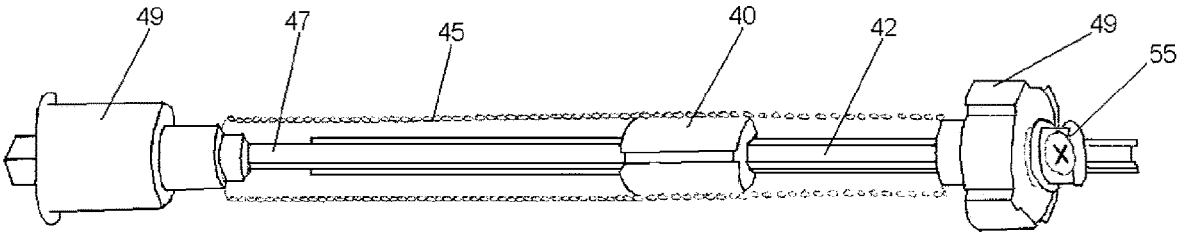
FIG. 7 illustrates the combination of elements depicted in FIG. 5 and FIG. 6 to produce a spring roller blind system.

Operation of the spring roller blind system is best described with reference to FIG. 7 illustrates the combination of elements depicted in FIG. 5 and FIG. 6.

Figure 5:
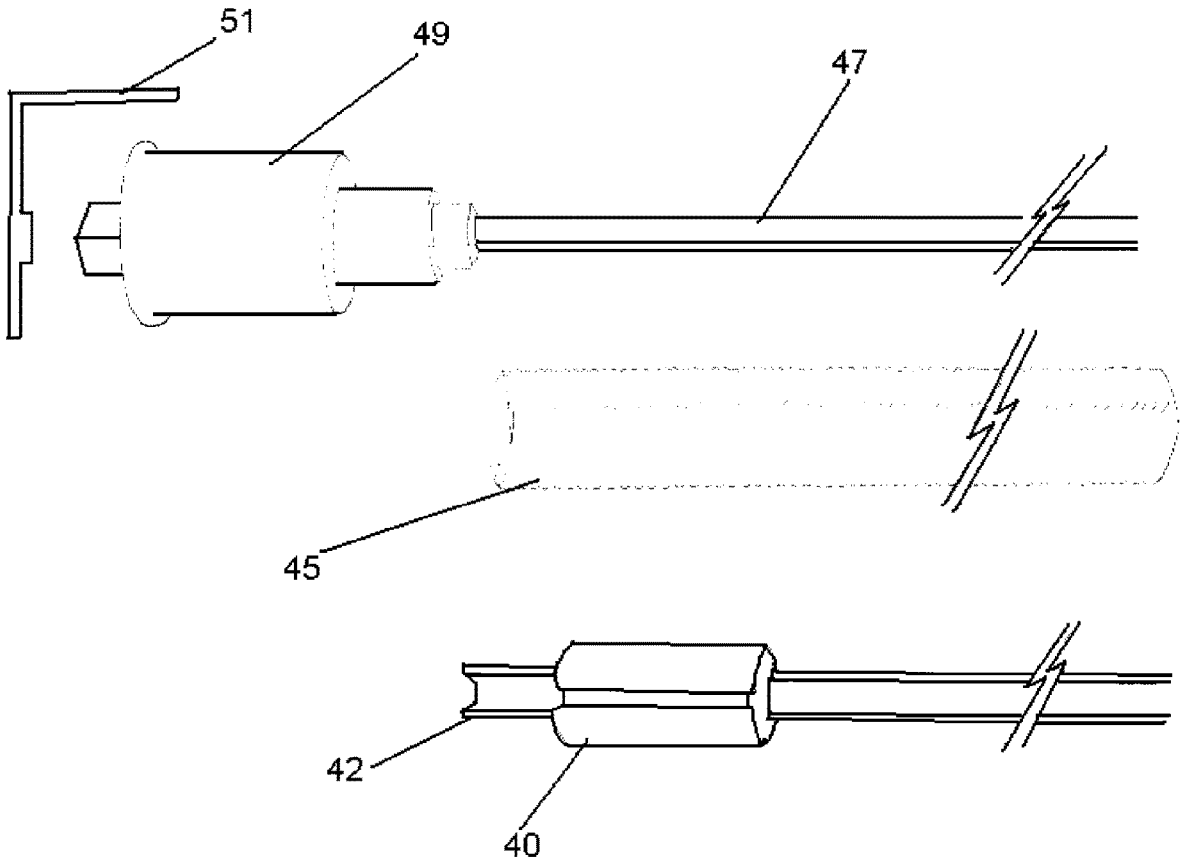
FIG. 5 illustrates the dampener of FIG. 3 relative to other elements at one end of the spring roller blind system.

FIG. 5 illustrates how the dampener (40) is positioned relative to other elements of the spring blind roller system. The dampener (40) is located on a rod (42) which in this embodiment is of substantially U-shaped. In use the rod (42) and dampener (40) reside within the torsion spring (45) which is shown in cross section. In the first embodiment, the recess of the U-shaped rod (42) receives a shaft (47) of square cross section which carries a pin end control unit at one end. When mounted on a wall or other structure the idler is supported on a bracket (51). In a second embodiment, the recess of the U-shaped rod (42) receives a shaft (47) of square cross section which carries a spring assist/idler (49) attached to the clutch at one end. When mounted on a wall or other structure the clutch is supported on a bracket (51).

FIG. 6 illustrates how the dampener (40) is positioned relative to other elements at the other end of the spring blind roller system. Specifically it shows the dampener (40) in position on the rod (42) at one end of which is a rotating bearing (49) which in use would rotate in unison with the cylinder and provides a centre support inside the cylinder. A lug (55) holds the rotating bearing in position on the U-shaped rod (42) and rod shaft (47) as shown in FIG. 7.

In an alternative embodiment, the bearing (49) can be fixed to one opposing end of the torsion spring and can cause the spring to tension as the cylinder rotates, while the other end of the torsion spring is fixed at the opposite end.

Specifically, the dampener (40) is fixed to the U-shaped rod (42) and the combined parts can be slid along the longitudinal axis and located in any desired position within the spring (45). In the first embodiment, rotation of the cylinder causes rotation of the housing (s really the outer housing around 49), which in turn turns the first or second end of the spring (45), reducing the coil diameter and concomitantly tightening against the dampener (40). As a result the spring coils between the control unit and the dampener (40) tighten, but the coils between the dampener (40) and the rotating bearing (49) do not tighten. Thus, the dampener effectively reduces the number of active coils, altering the k value of the spring. In this manner the operating dimensions of the spring can be matched to the operating dimensions of the blind.

FIG. 7 illustrates the individual elements depicted in FIGS. 5 and 6 when assembled.

Figure 8:
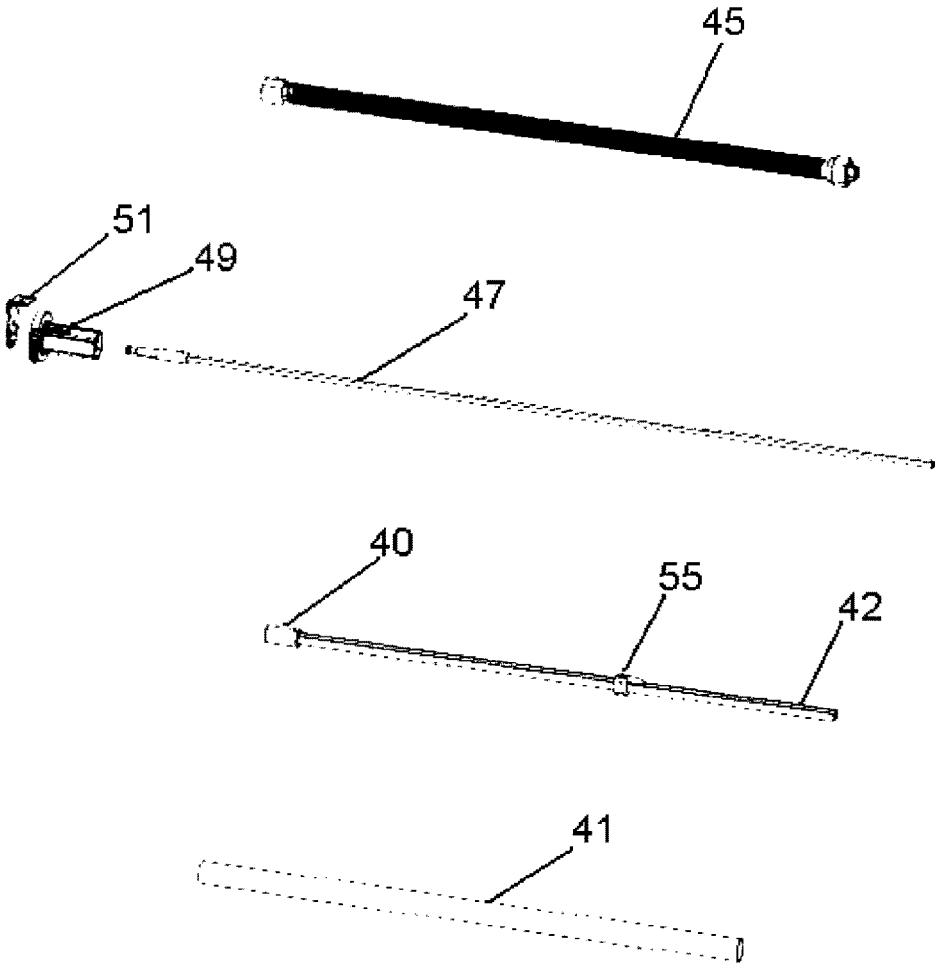
FIG. 8 illustrates a further embodiment of the invention incorporating a clutch in expanded view.
Figure 9:
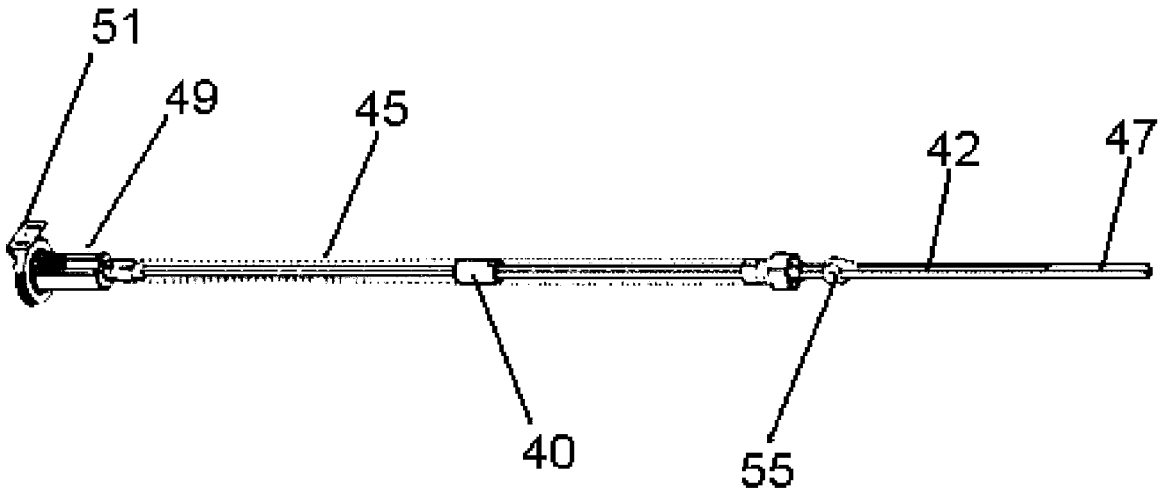
FIG. 9 illustrates the embodiment of the invention shown in FIG. 8 with a view of the clutch as assembled.

FIGS. 8 and 9 illustrate a further embodiment of the invention incorporating a clutch in exploded (FIG. 8) and assembled (FIG. 9) views. While the embodiment depicted in FIGS. 5, 6 and 7 illustrate the spring fitted at the idler end of the blind system, the embodiment shown in FIGS. 8 and 9 illustrate the spring fitted at the clutch end of the blind system, the clutch being driven manually by a chain, or preferably being driven by a small motor.

For purposes of description herein, the terms "upper," "lower," "right," "left," "rear," "front," "vertical," "horizontal," "interior," "exterior," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawing, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. Additionally, unless otherwise specified, it is to be understood that discussion of a particular feature of component extending in or along a given direction or the like does not mean that the feature or component follows a straight line or axis in such a direction or that it only extends in such direction or on such a plane without other directional components or deviations, unless otherwise specified.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. The described embodiments are to be considered in all respects as illustrative only and not restrictive.

Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures.

"Comprises/comprising" and "includes/including" when used in this specification is taken to specify the presence of stated features, integers, steps or components but does not preclude the presence or addition of one or more other features, integers, steps, components or groups thereof. Thus, unless the context clearly requires otherwise, throughout the description and the claims, the words 'comprise', 'comprising', 'includes', 'including' and the like are to be construed in an inclusive sense as opposed to an exclusive or exhaustive sense; that is to say, in the sense of "including, but not limited to".

The invention claimed is:

1. A method for altering the spring constant (k) of a torsion spring for a roller blind, the method including:

locating a dampener at a predetermined length along a longitudinal axis of the torsion spring, wherein the dampener is located on a u-shaped rod, and the combined parts of the dampener and the rod are slidable on a shaft along the longitudinal axis of the torsion spring, and tightening an end of the torsion spring against the dampener to increase the spring constant.

2. The method according to claim 1 wherein tightening the end of the torsion spring against the dampener reduces the operating length of the torsion spring and provides a pre-tension effect.

3. A roller blind system including:

a cylinder having a cylinder length and a cylinder diameter, a fabric attached to said cylinder for winding and unwinding from said cylinder, the fabric having a fabric length, a fabric weight, a fabric width, a thickness and a fabric height, a torsion spring having a first spring length, a longitudinal axis and operative to assist the cylinder in at least one direction of rotation, a damper moveable along the longitudinal axis of the torsion spring, wherein the damper k located on a u-shaped rod, and the combined parts of the damper and the rod are skiable on a shaft along the longitudinal axis of the torsion spring, wherein the damper is reversibly brought into contact with the torsion spring at a predetermined position so that a change in torque produced by the torsion spring upon rotation in a first direction balances a change in torque in a second, opposite direction which is produced by the weight of fabric as the cylinder rotates.

4. The roller blind system of claim 3 which additionally includes a weight bar extending along the width of the fabric.

5. The roller blind system according to claim 3 wherein the torque increase or decrease produced by the torsion spring upon rotation of the cylinder matches the increase or decrease in torque in the opposite direction that is produced by the weight of fabric as it is released from the cylinder during rotation of the cylinder.

6. The roller blind system according to claim 3 wherein the torque increase or decrease produced by the torsion spring upon rotation of the cylinder matches the increase or decrease in torque in the opposite direction that is produced by the weight of fabric as it is rolled onto the cylinder.

7. A roper blind system including:

a cylinder having a cylinder length and a cylinder diameter, a fabric attached to said cylinder for winding and unwinding from said cylinder, the fabric having a fabric length, a fabric weight, a fabric width, a thickness and a fabric height, a torsion spring having a first spring length, a longitudinal axis and operative to assist the rotation of the cylinder in at least one direction of rotation, a clutch adjacent a first end of the torsion spring, a damper moveable along the longitudinal axis of the torsion spring, wherein the damper is located on a u-shaped rod, and the combined parts of the damper and the rod are slidable on a shaft along the longitudinal axis of the torsion spring, wherein the damper is reversibly brought into contact with the torsion spring at a predetermined position so that a change in torque produced by the torsion spring upon rotation of the cylinder in a first direction balances a change in torque in a second, opposite direction which is produced by the weight of fabric as the cylinder rotates.

8. The roller blind system of claim 7 which additionally includes a weight bar extending along the width of the fabric.

9. The roller blind system according to claim 7 wherein the torque increase or decrease produced by the torsion spring upon rotation of the clutch balances the increase or decrease in torque in the opposite direction that is produced by the weight of fabric as it is released from the cylinder during rotation of the cylinder.

10. The roller blind system according to claim 7 wherein the torque increase or decrease produced by the torsion spring upon rotation of the clutch matches the increase or decrease in torque in the opposite direction that is produced by the weight of fabric as it is rolled onto the cylinder.

* * * * *